US005974753A

United States Patent [19]

Hsu

[11] Patent Number: 5,974,753

[45] Date of Patent: Nov. 2, 1999

[54] DETACHABLE FREE MOUNTING WALL SYSTEM

[76] Inventor: Oscar Hsien-Hsiang Hsu, 1969 Eva Dr., Lansdale, Pa. 19446

[21] Appl. No.: 09/100,196

[22] Filed: Jun. 18, 1998

[51] Int. Cl.[6] ..... E04B 2/00; E04F 13/08

[52] U.S. Cl. ..... 52/506.01; 52/DIG. 13; 52/506.05; 52/287.1; 52/385; 52/511; 52/764

[58] Field of Search ..... 52/DIG. 13, 506.01, 52/506.05, 506.07, 287.1, 762, 391, 384, 385, 764, 506.08, 511

[56] References Cited

U.S. PATENT DOCUMENTS

| | | | |
|---|---|---|---|
| 2,181,831 | 11/1939 | McLaughlin, Jr. . | |
| 3,125,192 | 3/1964 | Ramseur, Jr. . | |
| 3,721,050 | 3/1973 | Perina . | |
| 3,722,157 | 3/1973 | Prokop . | |
| 3,807,112 | 4/1974 | Perina . | |
| 3,863,412 | 2/1975 | Bodycomb et al. . | |
| 4,016,690 | 4/1977 | Richardson . | |
| 4,028,855 | 6/1977 | Prewer . | |
| 4,041,667 | 8/1977 | Lindner et al. . | |
| 4,272,934 | 6/1981 | Cowden et al. . | |
| 4,353,193 | 10/1982 | Sanderson . | |
| 4,430,835 | 2/1984 | Ericson | 52/DIG. 13 X |
| 4,462,193 | 7/1984 | Ericson . | |
| 4,535,578 | 8/1985 | Gerken . | |
| 4,558,549 | 12/1985 | See . | |
| 4,656,766 | 4/1987 | Cooper | 52/DIG. 13 X |
| 4,744,189 | 5/1988 | Wilson . | |
| 4,796,397 | 1/1989 | Capaul . | |
| 4,918,879 | 4/1990 | Bodurow et al. . | |
| 4,974,384 | 12/1990 | Pacione . | |
| 4,984,400 | 1/1991 | Bockmiller . | |
| 5,038,535 | 8/1991 | Van Praag, III . | |
| 5,060,443 | 10/1991 | Pacione . | |
| 5,070,666 | 12/1991 | Looman . | |
| 5,133,166 | 7/1992 | Pacione . | |
| 5,134,822 | 8/1992 | Edlin . | |
| 5,144,786 | 9/1992 | Pacione . | |
| 5,172,504 | 12/1992 | De Maat et al. . | |
| 5,259,163 | 11/1993 | Pacione . | |
| 5,361,556 | 11/1994 | Menchetti . | |
| 5,384,999 | 1/1995 | Roche et al. | 52/764 |
| 5,588,269 | 12/1996 | Wagner . | |
| 5,611,185 | 3/1997 | Wilz . | |
| 5,647,181 | 7/1997 | Hunts . | |
| 5,694,727 | 12/1997 | Dobija | 52/506.01 |
| 5,709,058 | 1/1998 | Shaw | 52/762 X |

FOREIGN PATENT DOCUMENTS

| | | | |
|---|---|---|---|
| 558888 | 2/1975 | Switzerland | 52/DIG. 13 |

*Primary Examiner*—Christopher T. Kent
*Assistant Examiner*—Brian E. Glessner
*Attorney, Agent, or Firm*—Elman & Associates

[57] ABSTRACT

A wall covering system includes prefabricated T-shaped (in cross section) horizontal supporting strips, L-shaped horizontal supporting strips, L-shaped end-locking strips and decorative panels. The end-locking strips interact with the horizontal strips and the decorative panels, provide an aesthetic appearance to the finished system when assembled on a wall and provide safety by covering the exposed ends of the T-shaped horizontal strips. In use, the wall panelling system disclosed herein may be easily and conveniently installed onto existing walls by a user without professional assistance and may be just as easily and conveniently removed from the wall whenever it is desired to inspect behind the panels, change the decor, or to remove the panels for installation at another location.

14 Claims, 7 Drawing Sheets

DETACHABLE FREE MOUNTING WALL SYSTEM

FIELD OF THE INVENTION

The present invention relates to a prefabricated wall covering system that may be easily and conveniently installed onto existing walls by a user without professional assistance. More particularly, the wall covering system of the present invention may be easily and conveniently removed from the wall whenever it is desired to inspect the underlying wall, install electrical wires or the like, change the decor, or to install the panels in another location.

BACKGROUND OF THE INVENTION

Various types of wall covering for homes, offices, hotels and other buildings are known. Walls may be painted or may be covered with wallpaper, fabric, wood-based panels, tiles, mirrors, plastics, marble sheets, cementitious substrates and the like. The appearance, durability and cost of wall coverings are of paramount importance as is the cost and difficulty of initial installation, of maintenance and eventual replacement.

Fabrics are often used to create a "rich" look and to counteract environmental noise, especially for walls surfaced with drywall. Fabrics may be applied with glue to drywall partitions and contrasting colors, patterns and textures of fabrics and the like may be used to achieve visual effects. The initial installation of fabric on wall coverings is however relatively expensive. In consequence, the use of fabrics has generally been confined to selected locations where expense is not a primary consideration. Moreover, traditional fabric wall coverings have the additional disadvantage that they are not readily removable.

The walls of domestic basements provide additional challenges to those of skill in the wall-covering arts. Many basements have cement or concrete walls, and satisfactory attachment of wall coverings is often difficult. Further, domestic basements are often accessed through small doorways and narrow stairways and large sheets of material cannot be readily brought to the site it is desired to cover. Also, because basements are often below-ground, moisture will often penetrate basement walls, making permanently affixed wall coverings unstable and hence unsuitable. Finally, when it comes to decorating or refinishing their basements, owners of residential property often wish to "do-it-themselves."

U.S. Pat. No. 4,744,198 to Wilson ("'198") teaches panels formed from "acoustic tackable board" and covered with fabric. The '198 patent teaches that the panels have VELCRO hook-and-loop fasteners on their back and that quick-disconnect fibrous fasteners should be located substantially at the geometric center of the rear surface of each panel so as to provide additional support for the removable wall panel. Additionally, the '198 panels are intended to be removable from walls.

U.S. Pat. No. 3,863,412 to Bodycomb ("'412") discloses wall panels that are detachably secured to wall studs by VELCRO hook-and-loop fasteners or the like. However, because VELCRO fasteners are insufficiently rigid to stop movement of the panel relative to the stud, the '412 patent teaches that the panel should be mounted on a stud in a manner that permits little if any relative movement between the panel and the stud when the panel is in position. Patent '412 teaches that VELCRO fasteners "are not commercially satisfactory for mounting panels as they permit the panels to shift too easily thus requiring means be provided to prevent this shifting." ('412 patent, col. 3, lines 33–36).

U.S. Pat. No. 5,144,786 to Pacione ("'786") discloses an anchor-board construction system including wall surface elements with hooks and an attachable area finish with loops to interact with the hooks. Area finishes are disclosed in Patent '786 to be carpet tiles, wallpaper or fabric with looped backing or wood paneling. The system disclosed in Patent '786 includes provision for trims, baseboards, cornice moldings, door moldings and outlet covers.

Therefore, it will be seen that there is a long-felt need for a wall covering system suitable for use in domestic basements, that may be installed by amateur decorators, and may be just as easily removed in the event of damage requiring replacement, or be changed to match the decor of the room.

SUMMARY OF THE INVENTION

The present invention comprises a detachable wall panelling system. More particularly, the present invention relates to a system with prefabricated T-shaped horizontal supporting strips, L-shaped top and bottom strips, L-shaped end-locking strips and decorative panels. The end-locking strips provide safety by covering the rough ends of the horizontal strips; provide structural re-enforcement by interacting with the horizontal strips and the decorative panels, and provide an aesthetic appearance to the finished system when assembled on a wall. In use, the present wall panelling system overcomes disadvantages and deficiencies of prior art wall covering systems by providing a decorative wall covering system, in the form of prefabricated support strips, end-finishing strips for safety and re-enforcing the wall structure, and removable panels which are attractively finished with a fabric covering or other suitable coating. Panels of the present invention are easily installed and can provide a "designer look" that can be color-coordinated with the furniture and decor. The prefabricated support strips of the present invention provide a positioning function to securely locate the wall panels of the present invention at their installed position. Panels of the present wall covering system invention that are covered with sound absorbent material can reduce noise and vibration in the room in which the system is installed. Further, the present invention eliminates the need to seal joints in wall paneling by cementing or taping and adds to structural integrity of walls to which it is applied. Additionally, the current invention achieves improved ventilation of basement walls and so help control unpleasant or musty odors which can occur in such locations.

One embodiment of the present invention comprises prefabricated top and bottom L-shaped strips and supporting strips having a T-shaped cross section wherein the lateral, wall-adjacent flanges of the T-shaped strips and L-shaped strips have, on the surface distal from the wall and adjacent to the protruding flange or central element, pre-positioned hook-strips of hook-and-loop fasteners.

Another component of embodiments of the invention are end-finishing strips positionable at the sides of a panel assembly. These end-finishing, or end-locking, strips provide structural reinforcement and, for safety, cover any rough edges. The L-shaped strips, T-shaped strips and end-finishing strips of the present invention are preferably formed from a metal or alloy such as aluminum, steel or a steel alloy. Alternatively they may be formed from milled wood, reconstituted wood products, or extruded plastic. As a further alternative, they may be formed from composite materials including wood/plastic composites, mineral/fiber composites, mineral-fiber/plastic composites and the like.

The L-shaped strips, T-shaped strips and end-finishing strips of the present invention can be fabricated by casting, molding, milling, forging, pressing or extruding, and a finished surface is provided by painting, coating, covering, plating or anodizing. Metal strips of the present invention may be finished in any number of other ways known to those of skill in the art such as painting, plating or anodizing.

A further component of the present invention is removable wall panels for homeowners, having positioned on the reverse side thereof loop-strips of hook-and-loop fasteners, so positioned to interact in use with hook-strips on the aforementioned supporting strips and finishing strips.

Decorative panels of the present invention can be made of plywood, chipboard, flake-board, particleboard, hardboard, oriented-strand board ("OSB"), softboard, medium-density fiberboard ("MDF"), strawboard, gypsum wall board, fiber/cement board, cementitious wall board, wood/plastic composite, wood/mineral-fiber composite, or a plastic composite. The decorative panels of the invention can have finished surfaces made of fabric, vinyl sheet, paint or varnish, tile, marble, or sheet metal.

In another embodiment of the present invention a covering is provided for the front surface of wall panel wherein the covering extends around the side and end edges of the panel and is secured to the rear surface of the panel. The covering in certain embodiments of the present invention are made of a fabric such as burlap, canvas, yard-goods or the like. In other embodiments, the panels are covered with leather, vinyl or other plastic sheet goods.

In other embodiments of present invention the panels have a finished surface that is painted, varnished, laminated or finished in other ways. In yet other embodiments of the present invention, the panels are sealed so as to resist the penetration of water and to render them waterproof or water resistant, and dimensionally stable.

Panels of the present invention are attached in use to the support strips by hook-and-loop fasteners. Preferably, the hook-and-loop type fasteners are VELCRO fasteners which are readily available. Such fasteners comprise two backing strips, one with hook-elements affixed thereto (a "hook-strip") and the other with loop-elements similarly affixed thereto (a "loop-strip"). Generally, in use, the hook-strips and loop-strips of such fasteners are fixed to different substrates which may then attached to one another by means of the interaction of the hook-elements of the fastener with the loop-elements of the fastener.

Embodiments of the present invention have a plurality of loop-strips of hook-and-loop fasteners positioned on the reverse surface of the panels. The loop-strips are preferably positioned adjacent to the edges of the board so as to interact in use with hook-strips of hook-and-loop fasteners on support strips of the present invention as heretofore described. Indeed, a continuous strip of loop-strip material may be positioned on the reverse side of panels of the present invention to facilitate ready positioning of panels of the present invention on the support strips. It will be appreciated that the relative positions of the hook-and-loop strips of the fasteners may be reversed without departing from the spirit of the present invention. However, it has been found advantageous to position the less-abrasive loop-strips of the fasteners on the panels so as to reduce the possibility of damage to panels during manufacturing and shipping. Further, it will be appreciated that a substantially continuous hook-strip may be provided on support strips of the invention to interact with small pieces of loop-strips positioned on the reverse side of panels of the invention. In an alternative embodiment, a substantially continuous loop-strip may be provided on panels of the invention to interact with small pieces of hook-strips positioned on support strips of the invention. Other types of fasteners may also be used in alternate embodiments of the invention.

A feature of an embodiment of the present invention is decorative wall panels, with or without fabric or other covering, which may be quickly removed without appreciable damage to the existing wall.

Still another feature of an embodiment of the present invention is wall panels, having a fabric covering, which may be arranged in a decorative manner to achieve a designer look with adjacent wall panels of the same or of conventional design.

Yet another feature of embodiments of the present invention is removable wall panels with or without a fabric covering, which improve the insulation and the acoustic properties of a room.

It is an object of the present invention to provide a wall panel system adapted to be quickly, easily and conveniently mounted onto an existing wall, such as a cement or concrete basement wall or onto a drywall partition wall or a frame wall without paneling, and from which the panels can be quickly, easily and conveniently removed. Yet another advantage of the present invention is that no special preparation to the existing wall is necessary before the invention is installed. Still another advantage of the present invention is that the quick and easy removal of panels readily allows inspection of a basement wall for moisture seepage. Indeed, damage caused by water to an installed panel wall covering of the present invention may be readily repaired by replacing the individual damaged panels. Additionally the present invention advantageously permits inspection behind the panels for faults in household systems, such as leaks in water pipes.

Still another advantage of the present invention is that the wall panels are readily removable by homeowners, so that cables and wires that serve sound systems, telephones and the like, may be installed behind such panels to provide improved decor and safety. A further advantage is that such wires and cables can be readily accessed when necessary for furniture rearrangement or maintenance.

A preferred embodiment of the present invention provides a wall panel system with panels of a size 16 by 24 inches, (41 by 62 cm.) so as to permit a homeowner to quickly, easily and conveniently transport the panels of the present invention into an existing residential basement through a narrow access way. A further advantage conferred by the removable wall panels of the present invention is that they permit homeowners to conveniently switch or redesign the decor of a basement or room.

In accordance with the present invention, there is herein illustrated and described a preferred embodiment of a wall panel system adapted to be easily installed onto an existing basement wall. The system is installed by attaching finishing strips to the wall along the top, bottom and lateral edges of the area to be panelled; attaching horizontal support strips to the wall in the area to be panelled; and positioning wall panels onto the end-locking support strips and finishing strips so as to link the loop-strips of hook-and-loop fasteners on the reverse side thereof with hook-strips on the aforementioned support and finishing strips.

These and other objects, features and advantages of the present invention will become apparent from a reading of the following detailed specification, taken in conjunction with the enclosed drawings.

DESCRIPTION OF THE PREFERRED EMBODIMENTS

Figure 1:
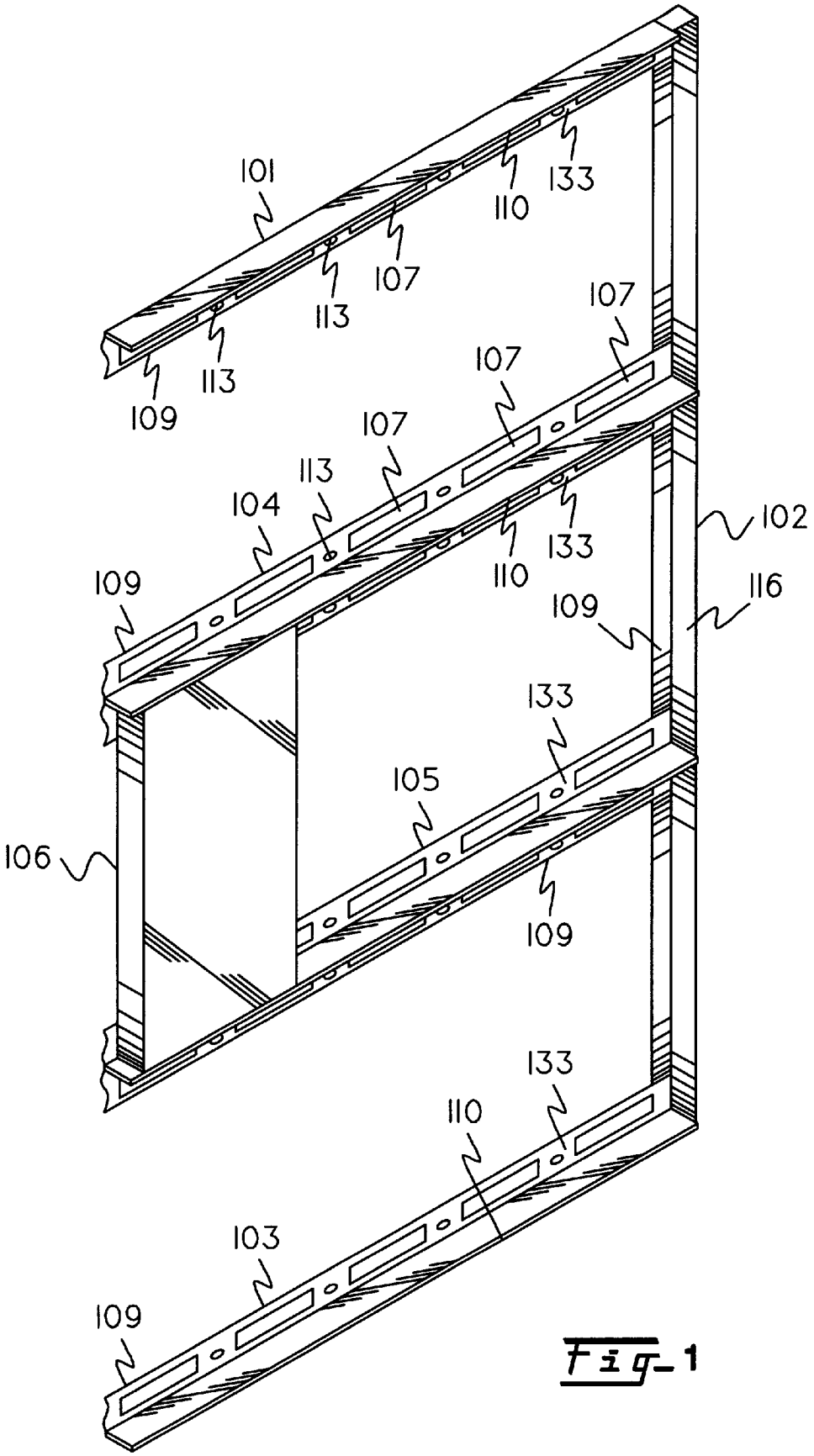
FIG. 1 shows a perspective view of the supporting strips and a panel of the present invention as they might be installed on an existing wall, such as a basement wall.
Figure 2A:
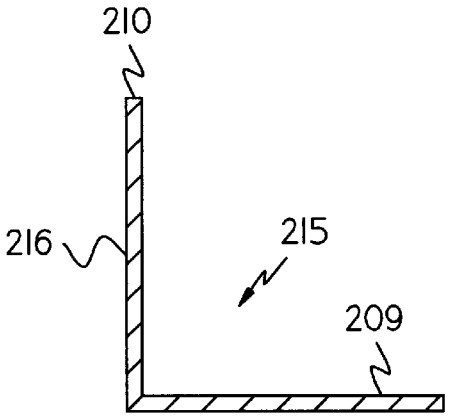
FIGS. 2*a*, 2*b*, 2*c* and 2*d* show transverse cross-sections of four embodiments of L-shaped strips of the present invention.
Figure 2B:
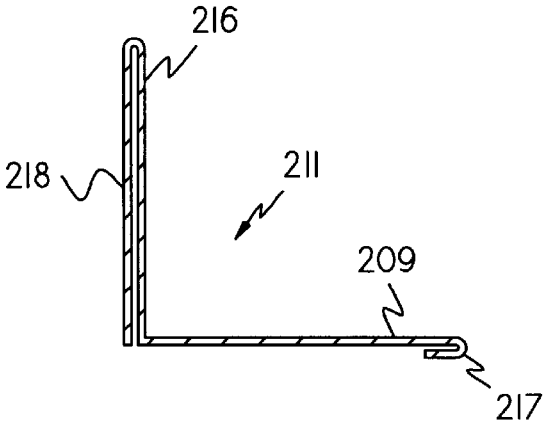
Figure 2C:
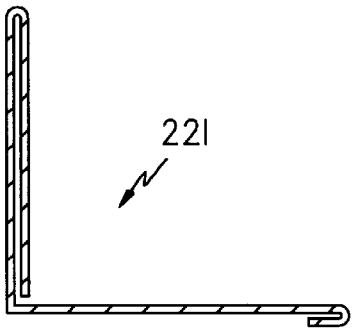
Figure 2D:
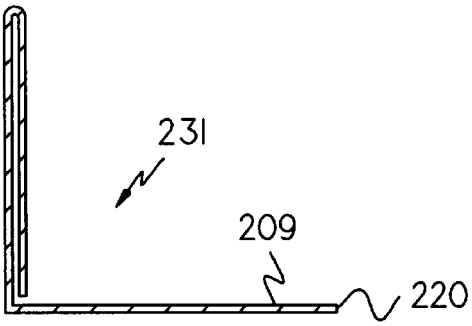

FIG. 1 shows the elements of the present invention positioned as they would be in use. L-shaped strips 101, 103 are positioned respectively at the top and bottom of an area to be panelled. T-shaped strips 104 are shown positioned a panel-width from a top strip 101 and a panel-width from a T-shaped strip 105. A T-shaped strip 105 is shown positioned a panel-width from a bottom strip 103. For clarity, a single panel 106 is shown positioned between T-shaped strips 104, 105 in FIG. 1. Hook-strips 107 of hook-and-loop fasteners are shown on the wall-distal surfaces 133 of the wall-adjacent flanges 109 of the T-shaped strips 104, 105 and the L-shaped strips 101, 103. Such hook-strips are present on all the wall-adjacent flanges of the strips 101, 103, 104, 105 but for clarity of illustration are not all identified by reference numerals in FIG. 1. The exposed edges 110 of the strips 101, 103, 104, 105 are finished to provide a decorative border to inserted panels. In use, the strips 101, 103, 104, 105 shown in FIG. 1, would be affixed to an existing wall by conventional means (not shown), such as nails, passed through the slotted holes 113 in the strips. Slotted holes 113 as shown in FIG. 1, are provided at a 16-inch spacing to facilitate attachment of the horizontal support strips 101, 103 and the T-shaped strips 104, 105 of the present invention to conventionally spaced studs of a studded wall. It will be appreciated that slotted holes at other spacings suitable for other uses will be obvious to those of skill in the art.

An end-locking strip 102 of the present invention has an L-shaped cross section. In use the lateral, wall-adjacent flange 109 of the end-locking strip 102 is slid behind the top and bottom L-shaped 101, 103 and behind the panels attached thereto. A protruding flange 116 of the end-locking strip covers sharp protruding edges of the horizontal strips 101, 103, 104, 105. See FIG. 6 for further detail of the end-locking strip.

With reference to FIG. 2, transverse cross-sections of alternate embodiments of L-shaped strips are shown. FIG. 2*a* shows a cross-section of a solid cast or forged, L-shaped strip 215. Also illustrated is a wall-adjacent flange, 209 an exposed edge 210 and the protruding flange 216 of the L-shaped strip 215. FIG. 2*b* shows a cross-section of an L-shaped strip 211 formed by folding a sheet of metal. This embodiment of the invention has a refolded edge 217 on the wall-adjacent flange 209. The protruding flange 216 has a refolded edge 218, which may extend the entire length of the flange 216 as shown, or may alternatively extend only partway, the same as is shown for refolded flange 217. FIG. 2*c* shows an alternate L-shaped strip 221 formed by a different folding of a sheet of metal. FIG. 2*d* shows a cross-section of an extruded L-shaped strip 231. This extruded embodiment of the present invention has a non-refolded edge 220 on the wall-adjacent flange 209.

Figure 3A:
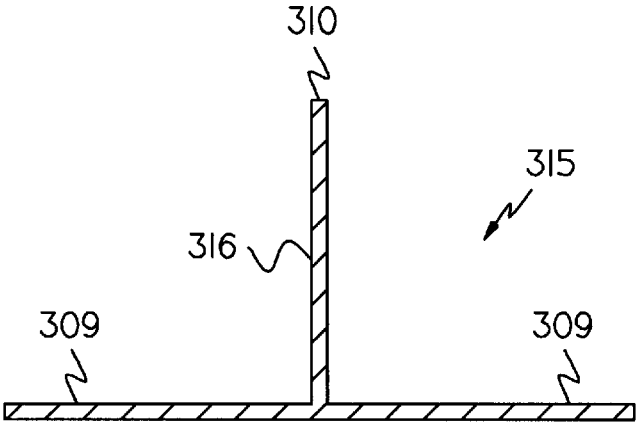
FIGS. 3*a*, 3*b* and 3*c* show transverse cross-sections of three embodiments of T-shaped strips of the present invention.
Figure 3B:
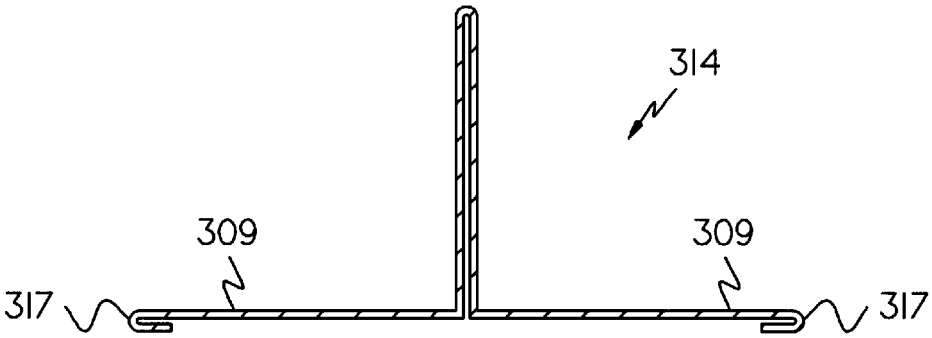
Figure 3C:
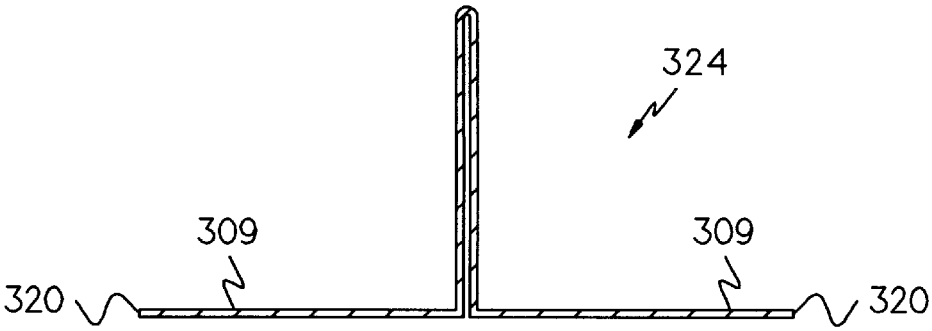

With reference to FIG. 3, transverse cross-sections of alternate embodiments of T-shaped strips are shown. FIG. 3*a* shows a cross-section of a solid, cast or forged T-shaped strip 315. Also illustrated are the wall-adjacent flanges 309, an exposed edge 310 and a protruding flange 316. FIG. 3*b* shows a cross-section of a T-shaped strip 314 formed by folding a sheet of metal. This embodiment of the invention has refolded edges 317 on the wall-adjacent flanges 309. FIG. 3*c* shows a cross-section of an extruded T-shaped strip 324. The extruded embodiment of the present invention shown in FIG. 3*c* has non-refolded edges 320 on the wall-adjacent flanges 309.

Figure 4:
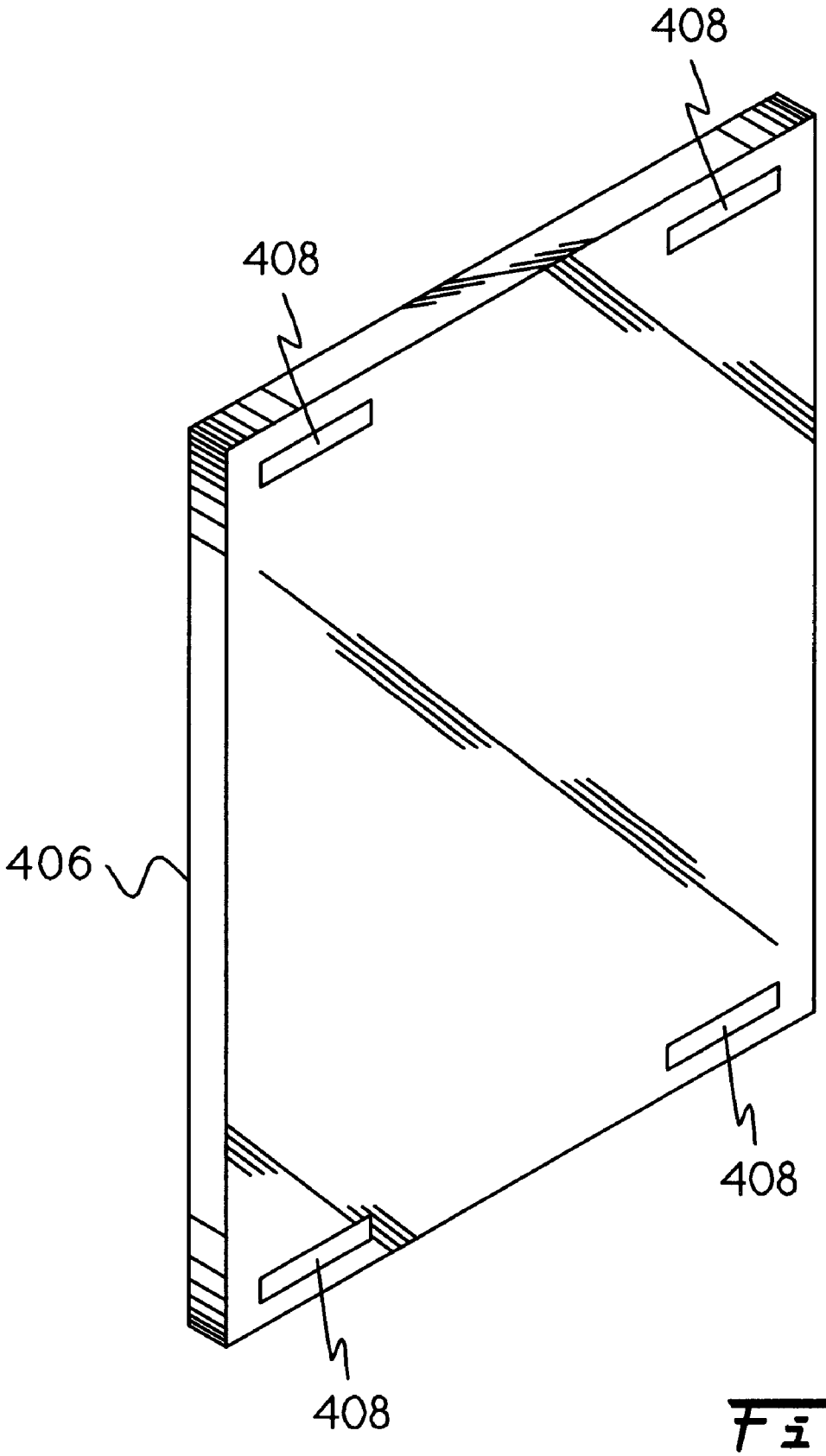
FIG. 4 shows a perspective rear view of a panel of the present invention.

With reference to FIG. 4, a rear view of a panel 406 of the present invention is shown. The location of loop-strips 408 of the hook-and-loop fasteners is shown.

Figure 5:
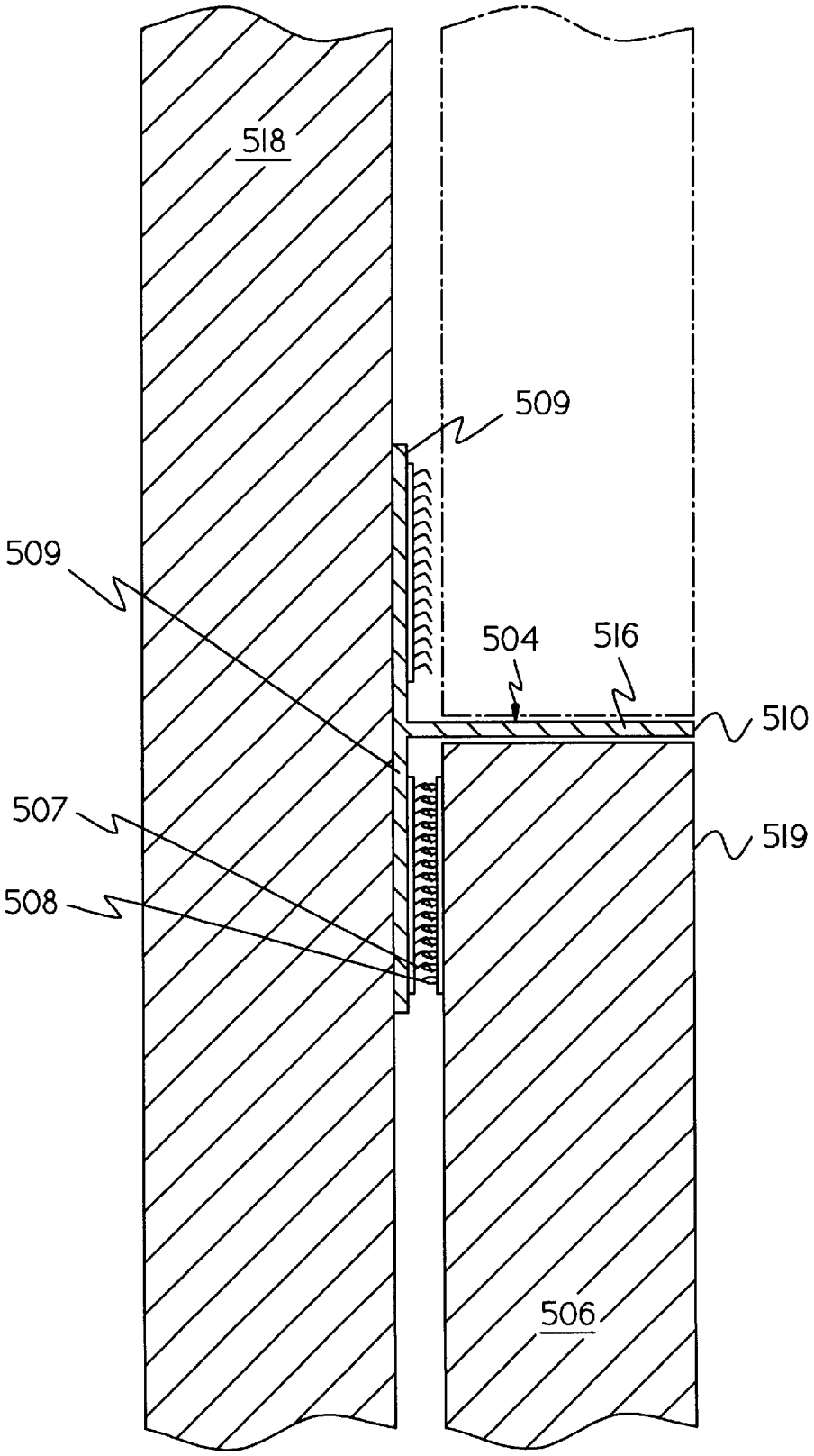
FIG. 5 is a vertical cross section that shows the manner of interaction of panels of the present invention with a T-shaped support strip.

With reference to FIG. 5, a cross-section of a portion of a non-covered panel, a T-shaped strip, and a wall are shown. The T-shaped strip 504 is mounted on a wall 518 with fixing devices, not shown, passed through the wall-adjacent flanges 509. A hook-strip 507 of a hook-and-loop fastener is shown mounted on a wall-adjacent flange 509 and interacting with a loop-strip 508 of a hook-and-loop fastener mounted on a panel 506. Also illustrated is a panel 506 closely fitted to the protruding flange 516 of a T-shaped strip 504 and the substantially co-planar positioning of an exposed edge 510 of a T-shaped strip 504 and the panel surface 519 of a panel 506. The position of an adjacent panel is shown dotted for illustration. In FIG. 5, a painted panel is shown for clarity of representation. The present invention also provides for substantially co-planar positioning of exposed edges of T-shaped strips, L-shaped strips and the surfaces of covered panels.

Figure 6:
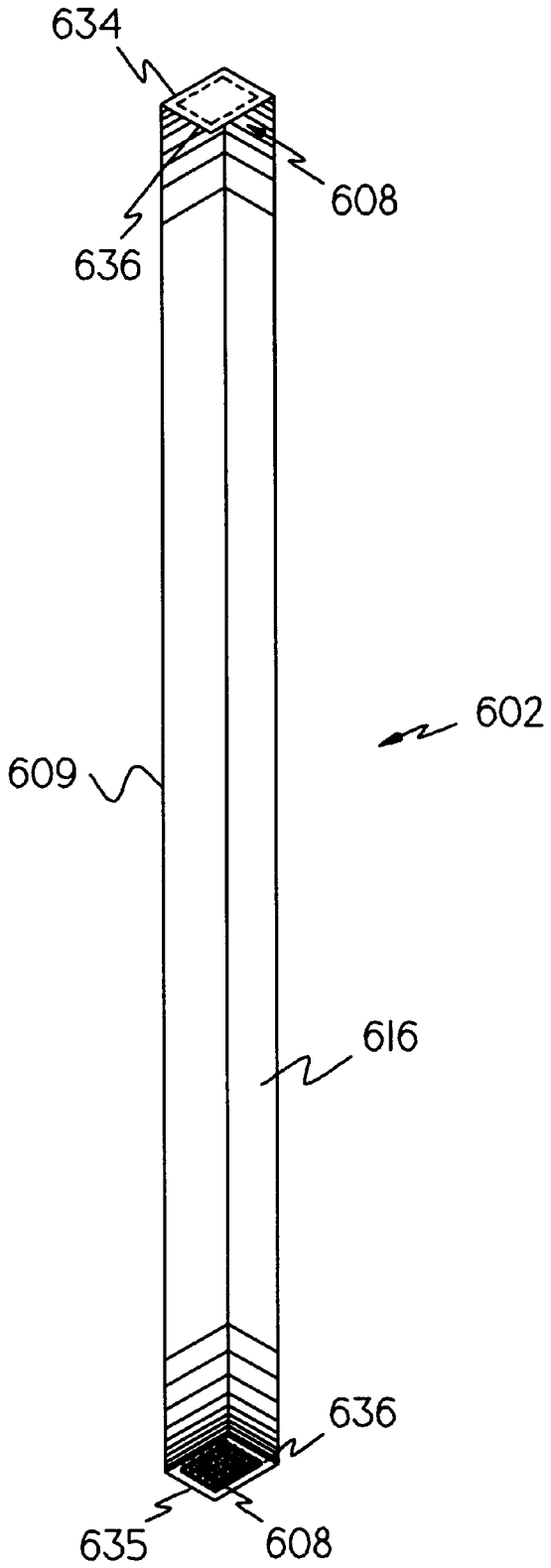
FIG. 6 shows a perspective view of an end-locking strip.

FIG. 6, illustrates an end-locking strip (or end-finishing strip) 602 of the present invention. FIG. 6 shows an end-locking strip 602 with an L-shaped cross section. In use, the lateral, wall-adjacent flange 609 of the L-shaped strip 602 is slid behind the top and bottom L-shaped strips and behind the panels attached thereto (not shown). The protruding flange 616 of each end-locking strip has, at its ends, portions 634, 635 that are folded or formed to extend towards the wall-adjacent flange 609 of the L-shaped strip 602 and which have pre-positioned hook-strips 608 of hook-and-loop fasteners positioned on the inner surfaces 636 of the folded portions 634, 635. L-shaped end-locking strips of the present invention are used by positioning loop-strips of hook-and-loop fasteners on the upper surface at the ends of L-shaped top strips and on the lower surface at the ends of L-shaped bottom strips so as to interact the aforesaid loop-strips with hook-strips present on the folded portions of the end-locking strips.

Preferably, panels of the present invention are 24 inches high by 16 inches wide, the width corresponding to the conventional horizontal spacing between building studs and the height to distances between the faces of protruding flanges of adjacent installed support strips of the present invention. Such panels are positionable in a side-by-side relationship between the supporting strips of the present invention. Preferably, each panel is substantially rectangular, although other shapes are feasible, consonant with the teachings of the present invention. Further, panels of widths other than 16 inches and heights other than 24 inches may however be readily used in the system of the present invention.

Figure 7A:
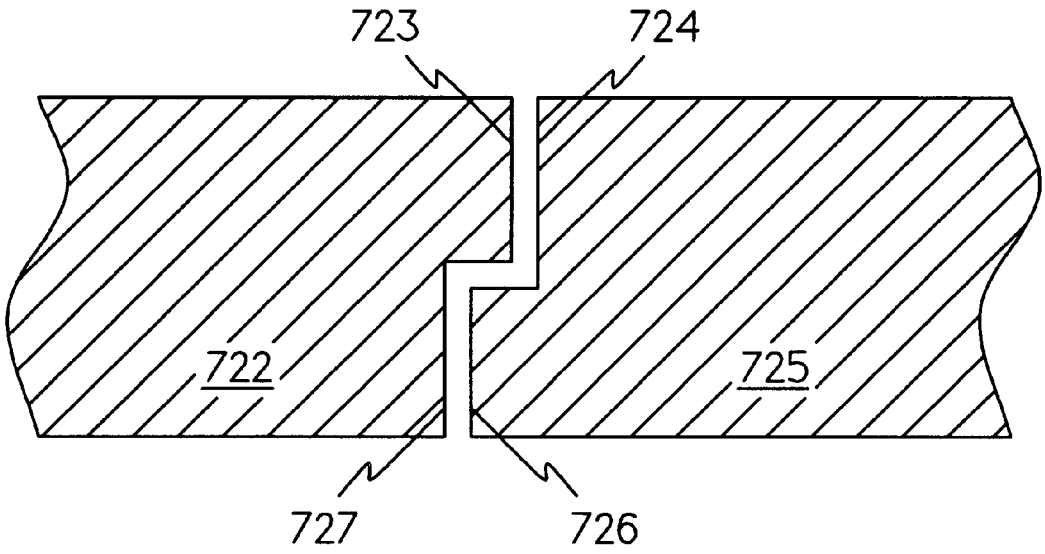
FIGS. 7*a* and 7*b* show horizontal cross sections of two alternate embodiments of interlocking panels of the present invention.
Figure 7B:
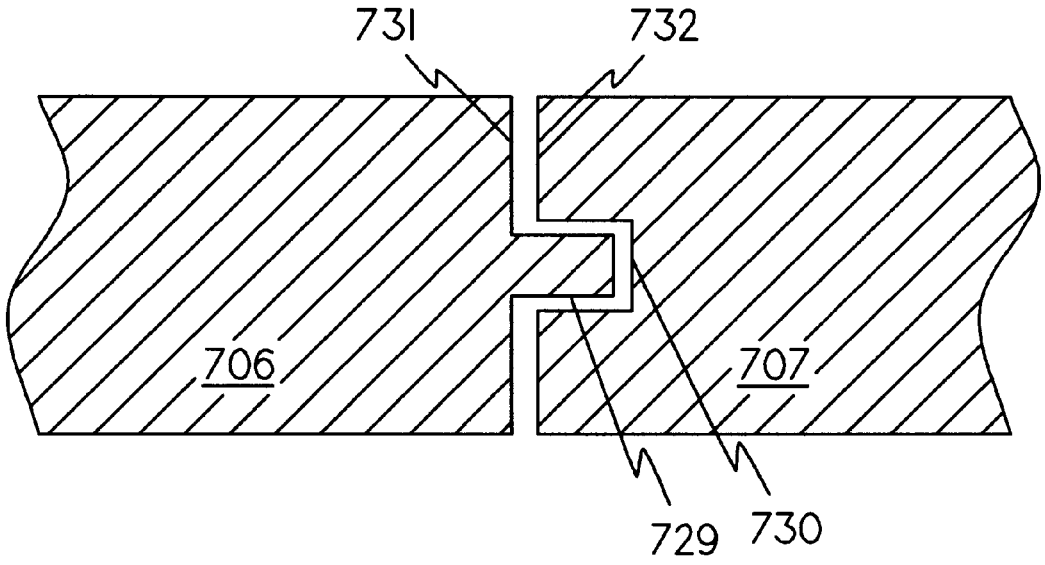

In another embodiment of the present invention, the panels are interlocking and have vertical edges shaped to lap over vertical edges of adjacent panels. FIG. 7*a* shows a cross section of the area of interaction between two adjacent lapped panels. The protruding portion 723 of a first panel 722 is shown positioned in a recessed portion 724 of a second panel 725. Reciprocally, the protruding portion 726 of the second panel 725 is positioned in the recessed portion 727 of the first panel 722. FIG. 7*b* illustrates the interaction of two panels of an alternate embodiment of interlocking panels of the present invention. FIG. 7*b* shows the edge 731 of a first panel 706 that has a tongue thereon 729 interacting, upon assembly, with a groove 730 in the edge 732 of an adjacent panel 707. Alternatively, the edge of a panel can be made V-shaped in cross-section to form a tongue-like protuberance, and the edge of an adjoining panel would be made V-shaped to mate with the protuberance.

T-shaped support strips of the present invention are made to be horizontally positionable on an existing wall set apart from adjacent strips at a distance so that panels of the present invention may be fitted therebetween. Similarly, the L-shaped top and bottom support strips are made to be secured to the wall.

Generally, to use the wall panelling system of the present invention, L-shaped support strips of the present invention, trimmed as needed to appropriate length, are first positioned at the bottom and top of the existing wall to be panelled, and are secured to the wall. T-shaped support strips of the present invention, trimmed as needed to appropriate length, are then set horizontally on the existing wall, set apart from adjacent strips higher and lower on the wall so that panels of the present invention may be fitted therebetween, and are secured to the wall. Panels of the present invention are then positioned between the supporting strips in a side-by-side relationship and end-locking strips are positioned at the end of each wall. It will be appreciated that end locking strips are not required to be used at an "inside" corner where two paneled walls abut one-another. Conventional headers or baseboards may be employed in conjunction with the present invention, if desired. Alternatively, panels of the present invention may be trimmed to fit between the topmost L-shaped strip and the T-shaped strip adjacent thereto. In that event, loop-strips (as described below) would be added near the trimmed edge to replace those that were removed when the panel was trimmed.

T-shaped support strips of the present invention are adapted to accept wall panels of the present invention. T-shaped support strips of the present invention have thereon hook-strips of hook-and-loop fasteners positioned so as to interact with loop-strips of hook-and-loop fasteners coordinately positioned on the reverse side of panels of the present invention. While there is no absolute position at which such interacting hook- and loop-strips are to be placed, the coordinate positioning of the hook-strip and the loop-strip is a feature of the present invention.

Hook-and-loop fasteners used in the preferred embodiments of the present invention are two-component fastening system sold by the Velcro Manufacturing Company of Manchester, N.H. under the trademark VELCRO. Similar fastening material is sold under the trademarks SCOTCH-MATE and MASTEX. More specific information about the VELCRO fastening system may be obtained from the literature, e.g., U.S. Pat. Nos. 2,717,437 and 3,114,951. As is known, this fastening system employs a pair of complementary elements. The first element (male) is a tape, i.e., a strip of fabric, from which of a multiplicity of tiny plastic hooks project (herein a "hook-strip"), and the second (female) is a corresponding strip from which a multiplicity of tiny plastic loops similarly project (herein a "loop-strip"). The two elements are adapted to be releasably secured by mere contact with each other. To that end, when the components are brought into contact with each other, many of the hooks of the male element engage many of the loops of the female element. When so secured, the two elements can be readily separated just by pulling them apart.

T-shaped strips and panels of the present invention preferably coordinated as to thickness with the protruding flanges of the T-shaped strips having a length which is substantially the same as the thickness of a panel, its covering, and the hook-and-loop fastener, so as to provide a substantially co-planar positioning of an exposed edge of a T-shaped strip and the panel surface. In other embodiments of the invention the protruding section of the T-shaped element may extend slightly above, or be recessed slightly below, the surface of the panels to provide an aesthetic appearance.

Each wall panel includes a substantially rigid board providing the core of the panel. Preferably, the board is formed of plywood, chipboard, flakeboard, particleboard, hardboard, oriented-strand board ("OSB"), softboard, medium-density density fiberboard ("MDF"), strawboard, gypsum wall board, fiber/cement board, cementitious wall board or any of a variety of other similar materials. A panel of the present invention has a generally rectangular form. Such a panel has a front surface, a rear surface, and peripheral edges. Panels of the present invention are preferably 16 inches in width by 24 inches in height. Those of skill in the art will be aware of other suitable dimensions. Preferred embodiments of the present invention have relatively small panels that are dimensionally stable, that may be readily maneuvered through narrow access ways into a basement and that may be easily handled by an individual.

Panels of the present invention may have a panel-covering a vinyl overlay, preferably a fabric stretched substantially taut over the front surface of the board and wrapped around the peripheral edges of the board. The panel-covering is secured to the rear of the board by conventional means, e.g., by stapling, gluing or the like. Panels of the present invention may alternatively have a finished front surface that is painted, varnished, embossed or finished in other ways known to those of skill in the art. In such embodiments the front surfaces and the edges of the panels are finished.

In yet another embodiment of present invention, the panels, and particularly their peripheral edges, are sealed so as to resist penetration by water. Such sealing is accomplished during the manufacture of the individual panels. Such water-resistant panels may have a finished surface that is painted, varnished or finished in other ways known to those of skill in the art. Such water-resistant embodiments are of particular use in basements that suffer from water seepage from the adjacent soil.

A plurality of loop-strips of hook-and-loop fasteners are positioned on the back of each panel, adjacent to the horizontal edge and near the vertical edges. The fasteners are coordinately positioned so as to facilitate attachment of wall panels to support strips of the invention when such strips are affixed to an existing wall. Preferably, each such fastener loop-strip is located substantially adjacent to vertical edge of the panel.

The T-shaped support strips and the end locking L-shaped finishing strips of the present invention may be applied to any existing wall, such as a concrete block or cinder block basement wall, or to a drywall partition wall and are preferably perforated for the passage of fixing means therethrough. Preferably the perforations are elongated or slot-shaped. Support and finishing strips may be attached by masonry nails, screws, or by other means known to those of skill in the art. Strips may optionally be attached by bonding or gluing. The T-shaped support strips and L-shaped finishing strips of the present invention may be formed by folding sheet metal such as aluminum or steel alloys or may be cast or rolled from metal billets. It has been found that T- and L-shaped strips suitable for use in the present invention may alternatively be made by extruding a suitable metal such as steel. Such metal strips may be painted or plated. Aluminum strips may be anodized. Alternatively such strips may be finished in other ways known to those of skill in the art. For example, the T-shaped support strips and L-shaped finishing strips of the present invention may also be finished by covering them with cloth material or coating them with plastic by a shrink-wrap or a spray-and-sinter type of process.

In other embodiments of the invention, the T-shaped support strips and L-shaped finishing strips of the present invention may also be formed from milled wood, reconstituted wood products, various composites or made from extruded plastic or be made from other suitable materials that will be known to those of skill in the art.

The wall panelling system of the present invention may be applied to basement or office walls or generally to any building structure. It may also be applied to existing wood panelling or to walls covered with paper or paint. It may be combined with, or interspersed with, conventional panelling, coverings, coatings, stone or brick, to provide an effect desired by an interior decorator.

Modifications to the embodiments described above may be made without departing from the basic spirit of the present invention. Accordingly, it will be appreciated by those skilled in the art that, within the scope of the appended claims, the invention may be practiced other than has been specifically described herein.

I claim:

1. A panelling system having component parts capable of being assembled in the field, comprising:

L-shaped top and bottom strips for assembly parallel to each other against a wall, each said strip having awall-adjacent flange and a protruding flange, said wall-adjacent flange having perforations therethrough and having on a wall-distal surface thereof a plurality of hook-strips of hook-and-loop fasteners;

T-shaped support strips for assembly parallel to said L-shaped strips, each said strip having two wall-adjacent flanges and a protruding flange, said wall-adjacent flanges having perforations therethrough and having on wall-distal surfaces thereof a plurality of hook-strip of hook-and-loop fasteners; and end locking strips for assembly perpendicular to said L-shaped strips and T-shaped strips, each end-locking strip having a protruding flange for covering sharp edges of said strips; and decorative panels having on rear surfaces thereof a plurality of loop-strips of hook-and-loop fasteners coordinately-positioned so as to facilitate interaction between said hook-strips and said loop-strips when said panels are assembled in said wall panelling system.

2. The wall panelling system of claim 1, wherein:

said L-shaped finishing strips are formed from a material selected from the group consisting of: metal, metal alloys, milled wood, reconstituted wood products, extruded plastic, wood/plastic composites, mineral/fiber composites, and mineral-fiber/plastic composites.

3. The wall panelling system of claim 1, wherein:

said T-shaped support strips are formed from a material selected from the group consisting of: metal, metal alloys, milled wood, reconstituted wood products, composites, extruded plastic, wood/plastic composites, and mineral-fiber/plastic composites.

4. The wall panelling system of claim 1, wherein:

said L-shaped top and bottom strips and said T-shaped strips are formed by a process selected from the group consisting of casting, molding, milling, forging, pressing and extruding, and finished by a process selected from the group consisting of painting, coating, covering, plating and anodizing.

5. The wall panelling system of claim 1, additionally comprising:

loop-strips of hook-and-loop fasteners positioned at an end of a top surface of said L-shaped top strip and at an end of a bottom surface of said L-shaped bottom strip; and said end-locking strips have hook-strips of hook-and-loop fasteners provided on inwardly folded portions for interacting with said loop-strips of hook-and-loop fasteners.

6. The wall panelling system of claim 1, wherein:

said decorative panels are formed from a material selected from the group consisting of: plywood, chipboard, flake-board, particleboard, hardboard, oriented-strand board, softboard, medium-density fiberboard, strawboard, gypsum wall board, cement/fiber board, cementitious wall board, wood/plastic composite, wood/mineral-fiber composite, and plastic composite.

7. The wall panelling system of claim 1, wherein:

said decorative panels have a finished surface selected formed from a surface selected from the group consisting of: fabric, vinyl sheet, paint, varnish, mineral, tile, marble, and sheet metal.

8. The wall panelling system of claim 7, wherein:

said decorative panels are sealed to render them water resistant and dimensionally stable.

9. The wall panelling system of claim 7, wherein:

said decorative panels are about 16 inches by 24 inches in size;

said plurality of coordinately-positioned loop-strips of hook-and-loop fasteners are positioned on said rear surface of each of said decorative panels; and said loop-strips are positioned on a horizontal edge of said rear surface and adjacent to the vertical edge thereof.

10. The wall panelling system of claim 1, wherein:

said plurality of coordinately-positioned loop-strips of hook-and-loop fasteners are positioned on said rear surface of each of said decorative panels; and said loop-strips are positioned along a shorter edge of said rear surface, adjacent to the corners thereof.

11. A method of installing decorative wall panels comprising the steps of:

(a) providing a wall panelling system in accordance with claim 1;

(b) permanently securing L-shaped top and bottom strips to extend horizontally along the top and bottom of a wall location to be provided with decorative panels;

(c) permanently securing at least one T-shaped support strip between the L-shaped strips, the vertical distance between the protruding flange of at least one of the L-shaped strips and the protruding flange of the adjacent T-shaped strip being the height of one of the decorative panels; and (d) placing at least one decorative panel between said strips so that it is removably secured there by hook-and-loop fasteners.

12. The method of claim 11, further comprising the step of repeating step (d) until the wall location is covered with decorative panels.

13. The method of claim 11, further comprising the step of:

placing an end-locking strip in a vertical position at an edge of said wall location.

14. The method of claim 13, further comprising the step of:

removing at least one of said decorative panels and replacing it with another decorative panel.

* * * * *

UNITED STATES PATENT AND TRADEMARK OFFICE

CERTIFICATE OF CORRECTION

PATENT NO. : 5,974,753
DATED : November 2, 1999
INVENTOR(S) : HSU

It is certified that error appears in the above-identified patent and that said Letters Patent is hereby corrected as shown below:

Column 9,
Line 44, "panelling" should read -- wall panelling --
Line 58, "hook-strip" should read -- hook-strips --

Signed and Sealed this

Twelfth Day of March, 2002

*Attest:*

*Attesting Officer*

JAMES E. ROGAN
*Director of the United States Patent and Trademark Office*